US009303848B2

(12) United States Patent
Lin et al.

(10) Patent No.: US 9,303,848 B2
(45) Date of Patent: Apr. 5, 2016

(54) LIGHT EMITTING DIODE LAMP STRUCTURE

(71) Applicants: GRT Tech Co., Ltd., New Taipei (TW); Hsuan-Chih Lin, New Taipei (TW); Chun-Cheng Lee, Taichung (TW)

(72) Inventors: Hsuan-Chih Lin, New Taipei (TW); Chun-Cheng Lee, Taichung (TW)

(73) Assignees: GRT TECH CO., LTD., New Taipei (TW); Hsuan-Chih Lin, New Taipei (TW); Chun-Cheng Lee, Taichung (TW)

( * ) Notice: Subject to any disclaimer, the term of this patent is extended or adjusted under 35 U.S.C. 154(b) by 108 days.

(21) Appl. No.: 14/468,799

(22) Filed: Aug. 26, 2014

(65) Prior Publication Data

US 2016/0061425 A1 Mar. 3, 2016

(51) Int. Cl.

| | |
|---|---|
| ***F21S 4/00*** | (2006.01) |
| ***F21V 21/00*** | (2006.01) |
| ***F21V 19/00*** | (2006.01) |
| ***F21K 99/00*** | (2010.01) |
| ***F21V 23/02*** | (2006.01) |
| ***F21V 23/00*** | (2015.01) |
| *F21W 111/02* | (2006.01) |

(52) U.S. Cl.

CPC ..... *F21V 19/0025* (2013.01); *F21K 9/30* (2013.01); *F21V 23/008* (2013.01); *F21V 23/023* (2013.01); *F21W 2111/02* (2013.01)

(58) Field of Classification Search

CPC ..... F21K 9/30; F21V 19/001; F21V 19/0015; F21V 19/0025; F21V 19/003; F21V 19/0035; F21V 19/004; F21V 19/0045; F21V 19/0055; F21V 23/008; F21V 23/023

USPC ..... 362/225, 249.02, 368, 457, 652, 362/655–656

See application file for complete search history.

(56) References Cited

U.S. PATENT DOCUMENTS

| | | | |
|---|---|---|---|
| 2006/0055333 | A1 | 3/2006 | Fiene |
| 2006/0087257 | A1 | 4/2006 | Choi et al. |

FOREIGN PATENT DOCUMENTS

| | | | |
|---|---|---|---|
| DE | 102008022834 | A1 | 11/2009 |
| EP | 1111297 | A1 | 6/2001 |
| EP | 1998107 | A1 | 12/2008 |
| WO | WO2014012296 | A1 | 1/2014 |

OTHER PUBLICATIONS

European Search Report Dated Nov. 3, 2014 of the corresponding European Application No. 14182205.6.

*Primary Examiner* — Jason Moon Han

(74) *Attorney, Agent, or Firm* — Chun-Ming Shih; HDLS IPR Services

(57) ABSTRACT

A light emitting diode (LED) lamp structure (100) of the present invention includes a housing body (102), a LED lamp module (500), and an electronic module (700, 700'). The housing body (102) includes a lamp base (200), a module base (400), a connecting ring (300) connecting the lamp base (200), and at least one clasping member (104) connecting the module base (400). The LED lamp module (500) connects the connecting ring (300) and is disposed on the lamp base (200). The electronic module (700, 700') connects the clasping member (104) and is disposed on the module base (400). Thereby, assembling, disassembling and replacing can be achieved without any tools. Meanwhile, the entrance of moisture is also prevented, so that a life span of an electronic device is prolonged.

19 Claims, 15 Drawing Sheets

LIGHT EMITTING DIODE LAMP STRUCTURE

BACKGROUND

1. Technical Field

The present invention relates to a lamp structure and, in particular, to a light emitting diode (LED) lamp structure in a modular design.

2. Related Art

Conventional road lighting equipments utilize a mercury lamp or a sodium lamp as a light source which illuminates a wider illumination zone but consumes more power, cannot be recycled, and therefore is not environmentally friendly. In recent years, the technology of a light emitting diode (LED) is increasingly developed. The LED has advantages such as high luminance, power-saving, environmental friendliness, a long life span, so has been widely used for lamp lighting and then used for road lighting.

When a street lamp malfunctions, it has to be repaired immediately in order to protect safety of passers-by. In general, a repairman has to use an elevated work platform (such as a cherry picker) in order to replace or repair the street lamp. However, most malfunction conditions of conventional street lamps are scenarios in which a power supply device or a sensor controlling on-and-off of the LED street lamp is damaged or malfunctioning. The repairman has to remove a lampshade or a housing of an LED street lamp, and then disassemble the said lamp to check and repair components one by one. Even worse, a whole set of the street lamp structure has to be replaced. Therefore, such a maintenance method not only wastes time but also increases maintenance costs.

Furthermore, since there are various street lamp structures in which the structures are complicated and do not have a unified standard. If the original manufacturers do not produce some component, it will cause problems and inconveniences in the repairing and maintenance of the street lamps.

In view of the foregoing, the inventor made various studies to improve the above-mentioned problems to realize the improvements by inventing a LED lamp structure and a street lamp utilizing the same.

BRIEF SUMMARY

It is an object of the present invention to provide a light emitting diode (LED) lamp structure, in which assembling, disassembling and replacing can be achieved without any tools, and meanwhile, the entrance of moisture is also prevented, so that a life span of an electronic device is prolonged.

Accordingly, the present invention provides a LED lamp structure comprising a housing body, a LED lamp module, and an electronic module. The housing body includes a lamp base, a module base, a connecting ring connecting the lamp base, and at least one clasping member connecting the module base. The LED lamp module connects the connecting ring and is disposed on the lamp base. The electronic module connects the clasping member and is disposed on the module base.

The present invention also has the following effects: after the LED lamp module is in alignment with the lamp base, it only requires inserting the LED lamp module into the lamp base and rotating the LED lamp module by a small angle, and then the assembly can be achieved fast and stably. Therefore, even an ordinary consumer can finish assembling or disassembling in a simple and efficient way. Furthermore, the preset invention has a wide application field which including the street lamp structure but not limited thereto. The application field of the electronic module of the present application includes a power-and-signal supply device, a wireless inductive module, and other electronic products requiring fast assembling and disassembling.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
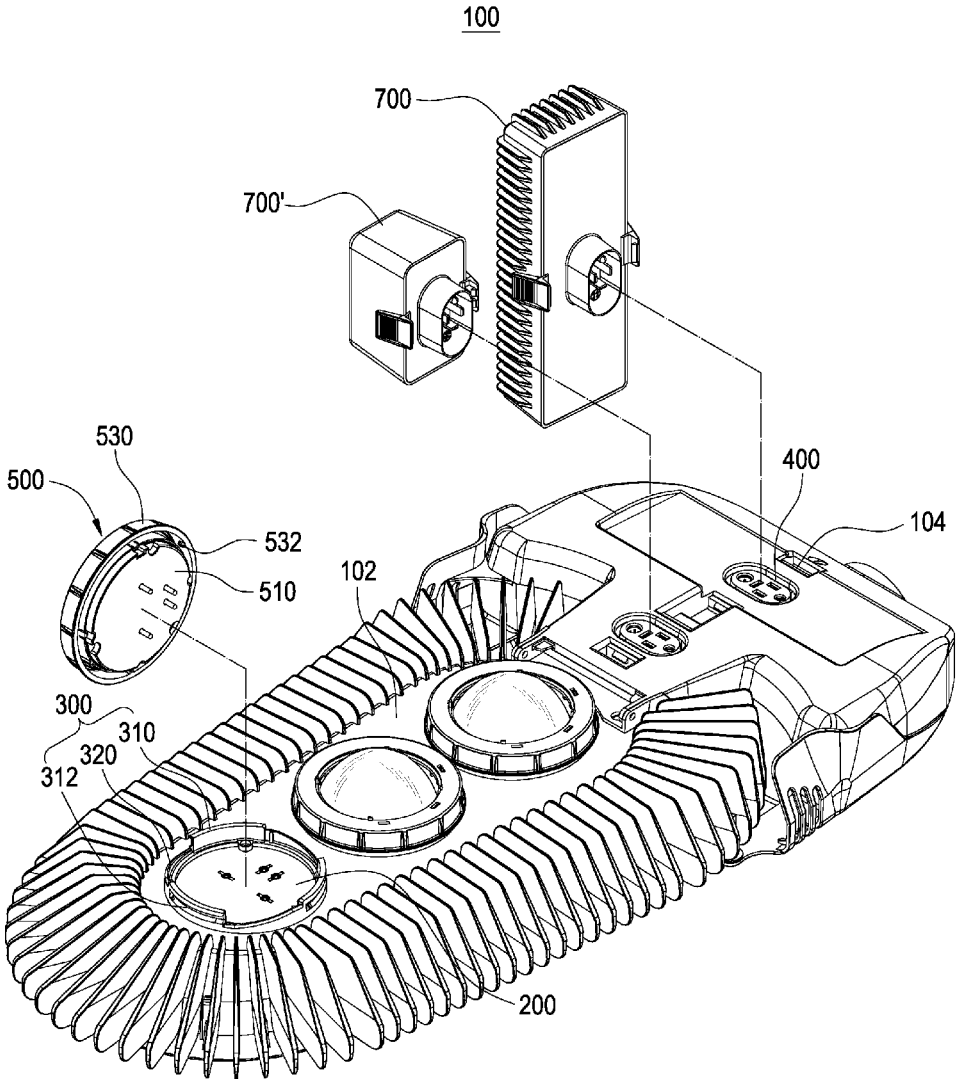
FIG. 1 is a partially exploded view of a light emitting diode (LED) lamp structure according to a first embodiment of the present invention.

Referring to FIG. 1, the present invention provides a light emitting diode (LED) lamp structure 100 which comprises a housing body 102, a LED lamp module 500 and an electronic module 700, 700'. The electronic module 700, 700' is preferably a power-and-signal supply device, supplying power and signals, and/or a wireless smart inductive appliance (not illustrated) controlling on-and-off, brightness, or an illumination time of an LED light source (not illustrated). The wireless smart inductive appliance herein needs to be used with a monitor host (not illustrated). A user operates the monitor host to transmit a wireless signal to the wireless inductive appliance to control the LED lamp module 500 of the foregoing embodiment.

In the present embodiment, the housing body 102 has a lamp base 200, a module base 400, a connecting ring 300 connecting the lamp base 200, and at least one clasping member 104 connecting the module base 400. The connecting ring 300 includes a plurality of press portions 310 and a plurality of notches 320 spaced apart from one another and respectively disposed between each two adjacent press portions 310. A guiding groove 312 is formed on an outer surface of each of the press portions 310. The LED lamp module 500 is disposed on the lamp base 200 and corresponding to the connecting ring 300. The LED lamp module 500 has a light source 510 and a rotatable ring 530 enclosing the light source 510. An inner wall of the rotatable ring 530 has a sliding block 532 correspondingly and rotatably engaged with the guiding groove 312. The electronic module 700, 700' is disposed on the module base 400 and corresponding to the clasping member 104, and this structure will be described later.

The related structure of the LED lamp module 500 of the present embodiment will be described hereinafter with reference to FIG. 2. Preferably, the connecting ring 300 is ring-shaped, consists of plastic or metal, and is positioned and fixed on the housing body 102 by screws (not illustrated). Each of the notches 320 and the press portions 310 is equidistant from one another on the connecting ring 300. In another preferable embodiment, the connecting ring 300 can be integrally formed with the housing body 102. According to the present embodiment, each of the notches 320 and the press portions 310 divides the connecting ring 300 into 6 parts, and each part substantially has a central angle of 60 degrees. However, in different embodiments, each of the notches 320 and the press portions 310 divides the connecting ring 300 into 4 parts, and each part substantially has a central angle of 90 degrees.

It should be noted that, the connecting ring 300 of the present embodiment consists of plastic or metal and is fixed to the lamp base 200 by screws or other components. If the connecting ring 300 is damaged or malfunctions accidentally, the connecting ring 300 can be detached and replaced fast, thus facilitating repairing or assembling of the LED lamp module 500. Furthermore, in order to conduct heat generated by the LED lamp module 500 to outside the lamp base 200, the housing body 102 further includes a plurality of radiating fins 106 disposed around the lamp structure 100.

Figure 2:
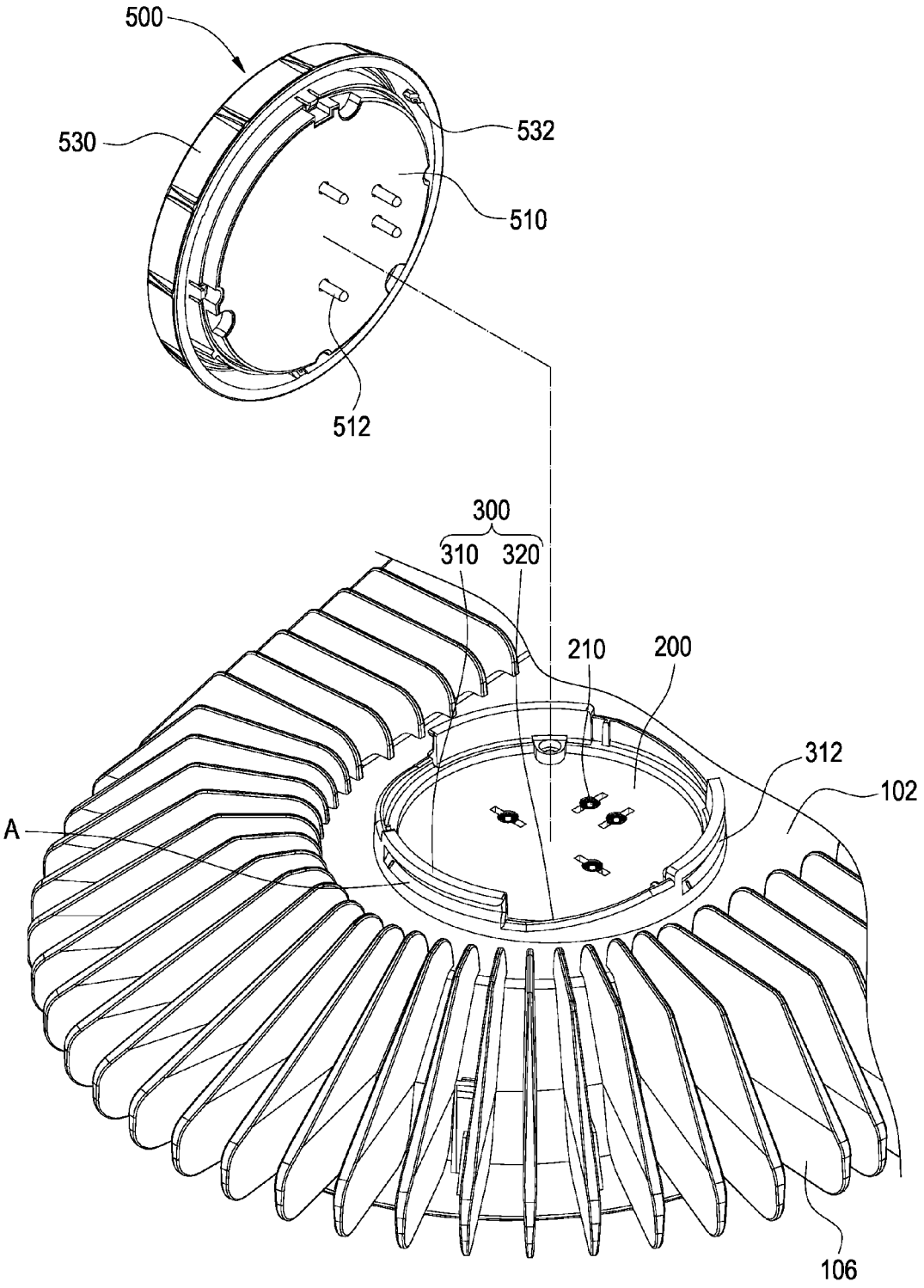
FIG. 2 is a partially enlarged view of a LED lamp module shown in FIG. 1.

Referring to FIG. 2, a guiding groove 312 is formed on an outer surface of each of the press portions 310, and the guiding groove 312 is adjacent to each of the notches 320, the guiding groove 312 and a surface of the housing body 102 together include an inclined angle A. An inclination direction of the inclined angle A is from away from a surface of the housing body 102 gradually toward the surface of the housing body 102. That is to say, the direction of the guiding groove 312 is inclined from upper right to bottom left. Furthermore, the notch 320 similarly has the inclined angle A, thereby making the LED lamp module 500 be easily in alignment with the notch 320 and quickly guided into the guiding groove 312. On the contrary, to disassemble the LED lamp module 500 from the lamp base 200, the notch 320 having the inclined angle A can successfully make the LED lamp module 500 detached from the lamp base 200 in a vertical direction. Thereby, the assembly and disassembly operation can prevent damaging an electric signal connector (i.e. a conductive terminal 512) of the LED lamp module 500.

Figure 3:
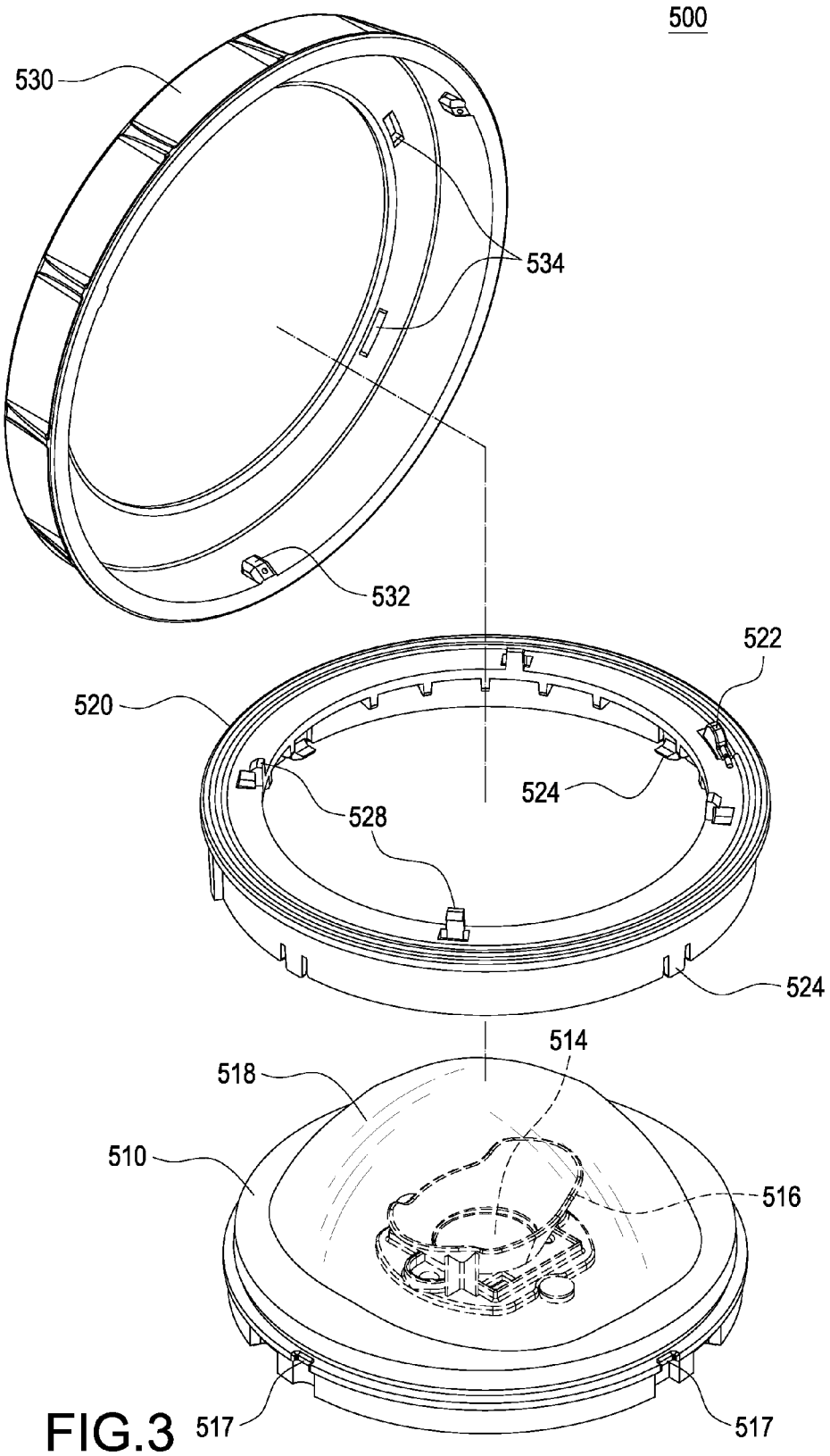
FIG. 3 is a schematic exploded view of the LED lamp module according to the present invention.
Figure 4:
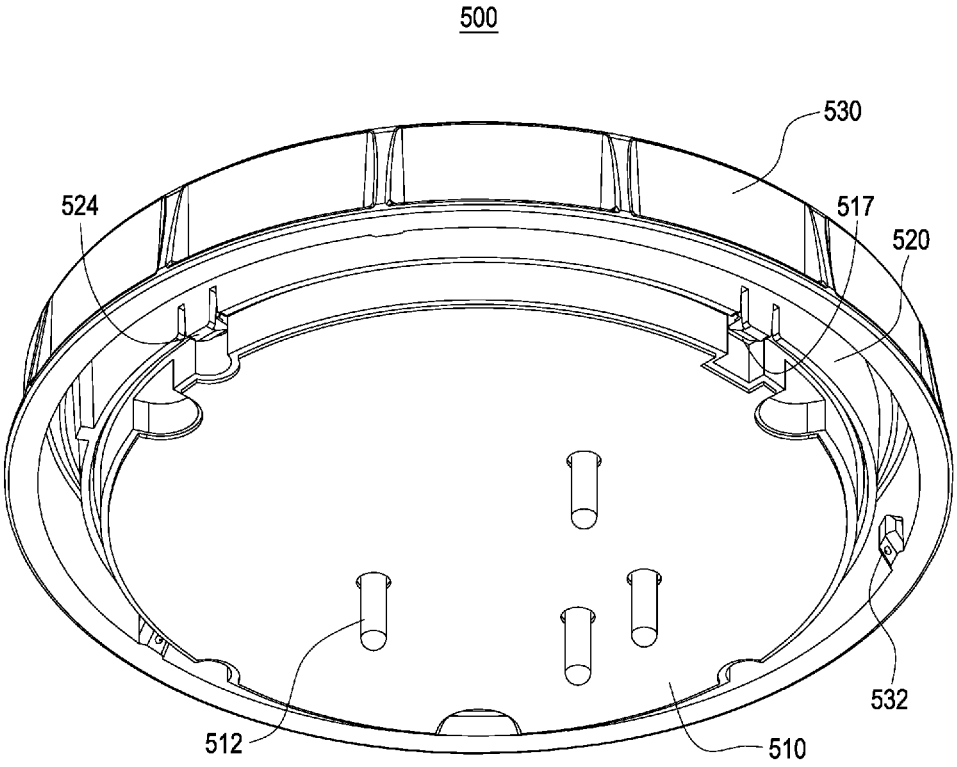
FIG. 4 is a schematic view illustrating an assembled state of the LED lamp module according to the present invention.
Figure 5:
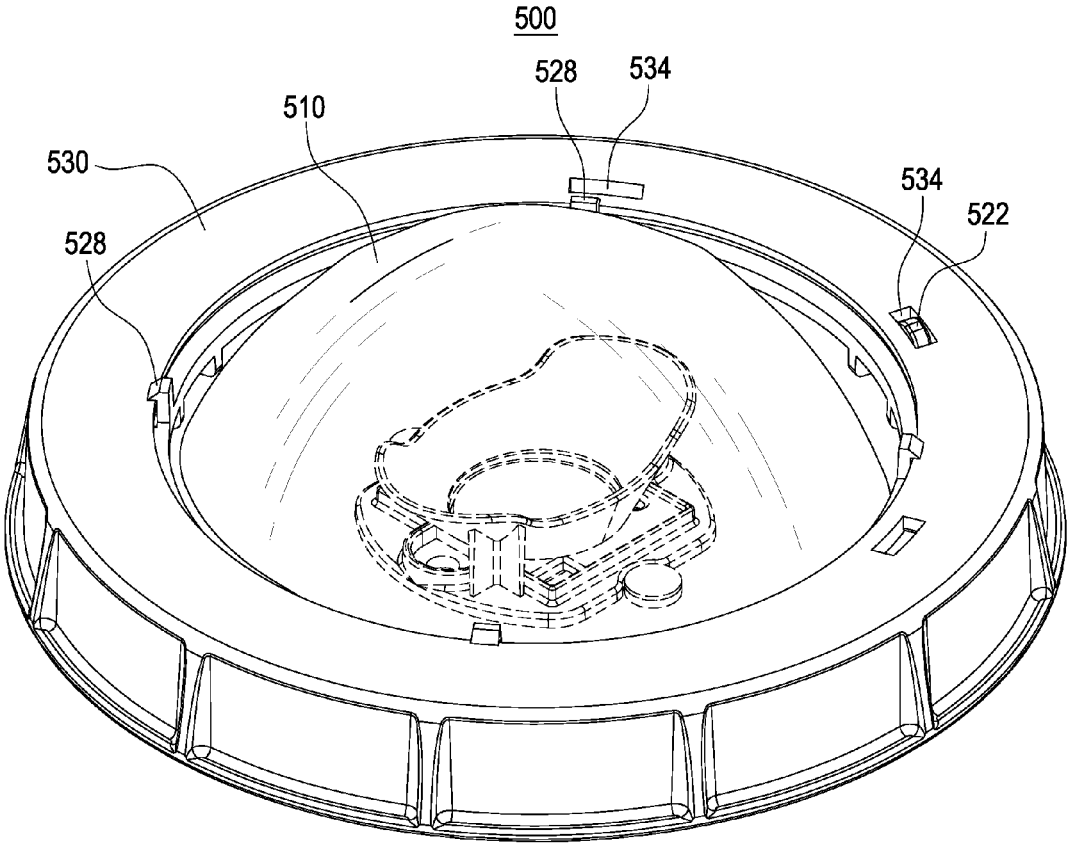
FIG. 5 is a schematic view illustrating the assembled state, from another viewing angle, of the LED lamp module according to the present invention.
Figure 6:
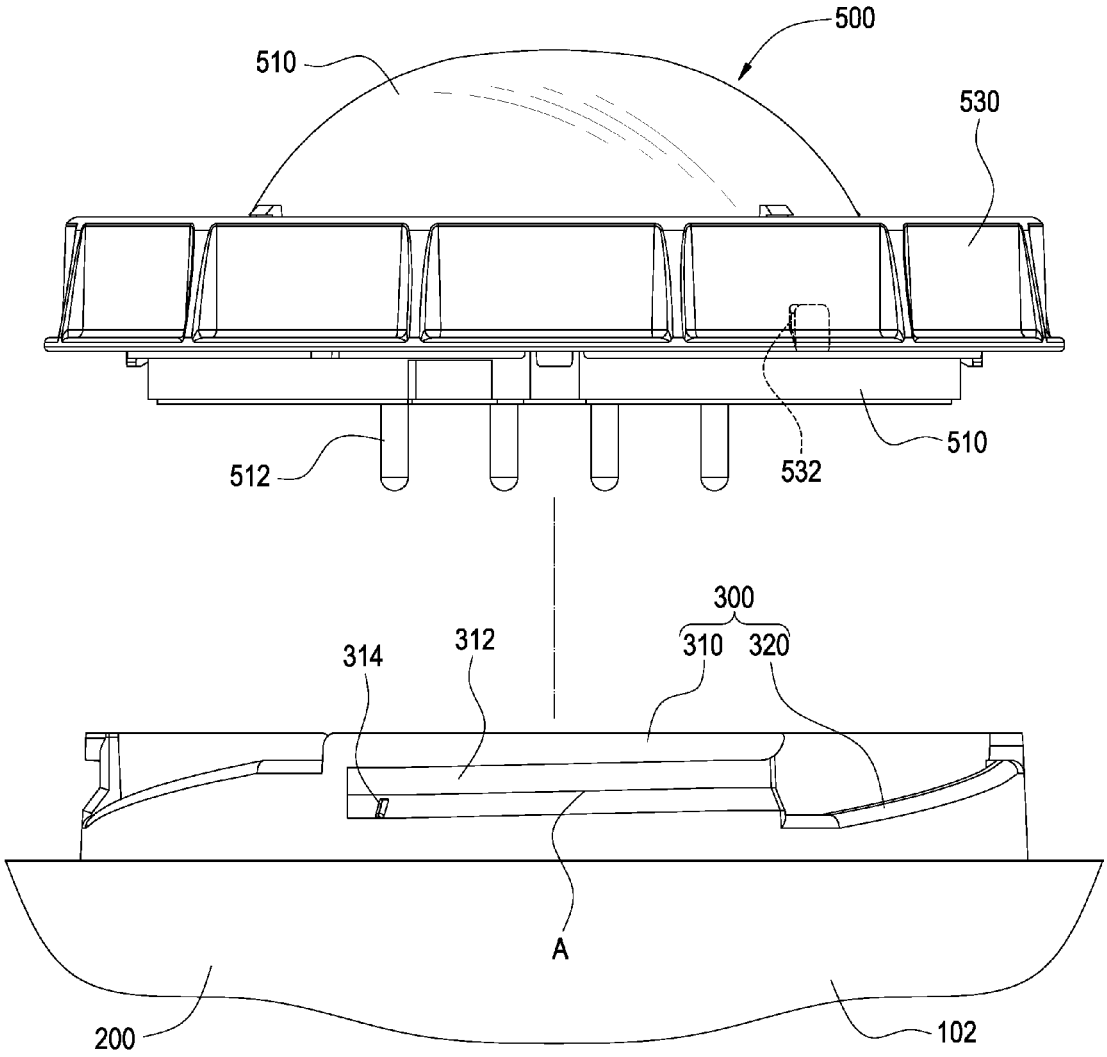
FIG. 6 is a schematic view illustrating assembling the LED lamp module.

Referring to FIGS. 3, 4, and 5, the LED lamp module 500 includes the light source 510 and the rotatable ring 530 enclosing the light source 510. According to the embodiment shown in FIG. 3, the light source 510 consists of the conductive terminal 512, an LED 514, a plastic cup 516, a lens 518, related circuits (not illustrated), and other components. The related components belong to conventional techniques, and thus a repetitive description thereof is omitted herein.

The LED lamp module 500 further includes a joining ring 520 and an elastic positioning portion 522. The joining ring 520 is hollow and has some integrally-formed fastening portions 524 to engage corresponding recesses 517, so as to position and fix the joining ring 520 on the light source 510. The joining ring 520 has some hook portions 528 on the other lateral edge opposite to the fastening portions 524. Each hook portion 528 hooks an inner edge of an open hole of the rotatable ring 530, so as to restrict a movement of the rotatable ring 530 along an axial direction. The elastic positioning portion 522 elastically reciprocate on a circular-arc-shaped surface of the joining ring 520, which allows visual inspection of the rotatable ring 530 to determine whether it is rotated to a locked state.

Referring to FIG. 3 and FIG. 5, an outer surface of the rotatable ring 530 further forms a plurality of openings 534, and the elastic positioning portion 522 is disposed corresponding to the opening 534. When the rotatable ring 530 rotates, the hook portion 528 restricts the movement of rotatable ring 530 along the axial direction, but does not affect the rotation of the rotatable ring 530. Furthermore, when the rotatable ring 530 rotates, the elastic positioning portion 522 moves from one of the openings 534 to engage an adjacent or corresponding one of the openings 534. The location of each opening 534 is designed according to a rotation distance of the guiding groove 312 on the press portion 310, which is for example 90 degrees or 60 degrees and varies according to requirements or designs.

Figure 7:
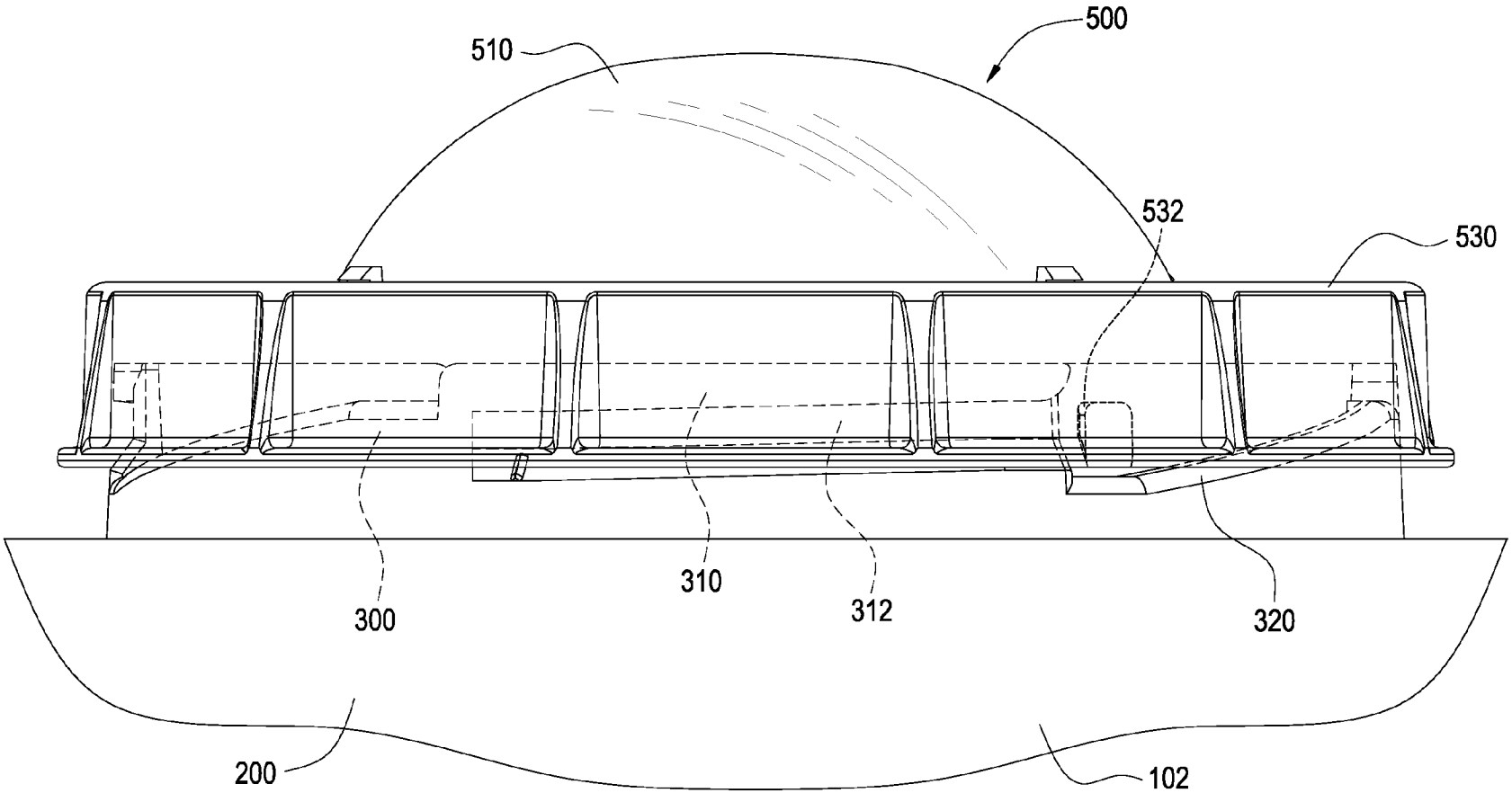
FIG. 7 is another assembly operational view illustrating assembling the LED lamp module.
Figure 8:
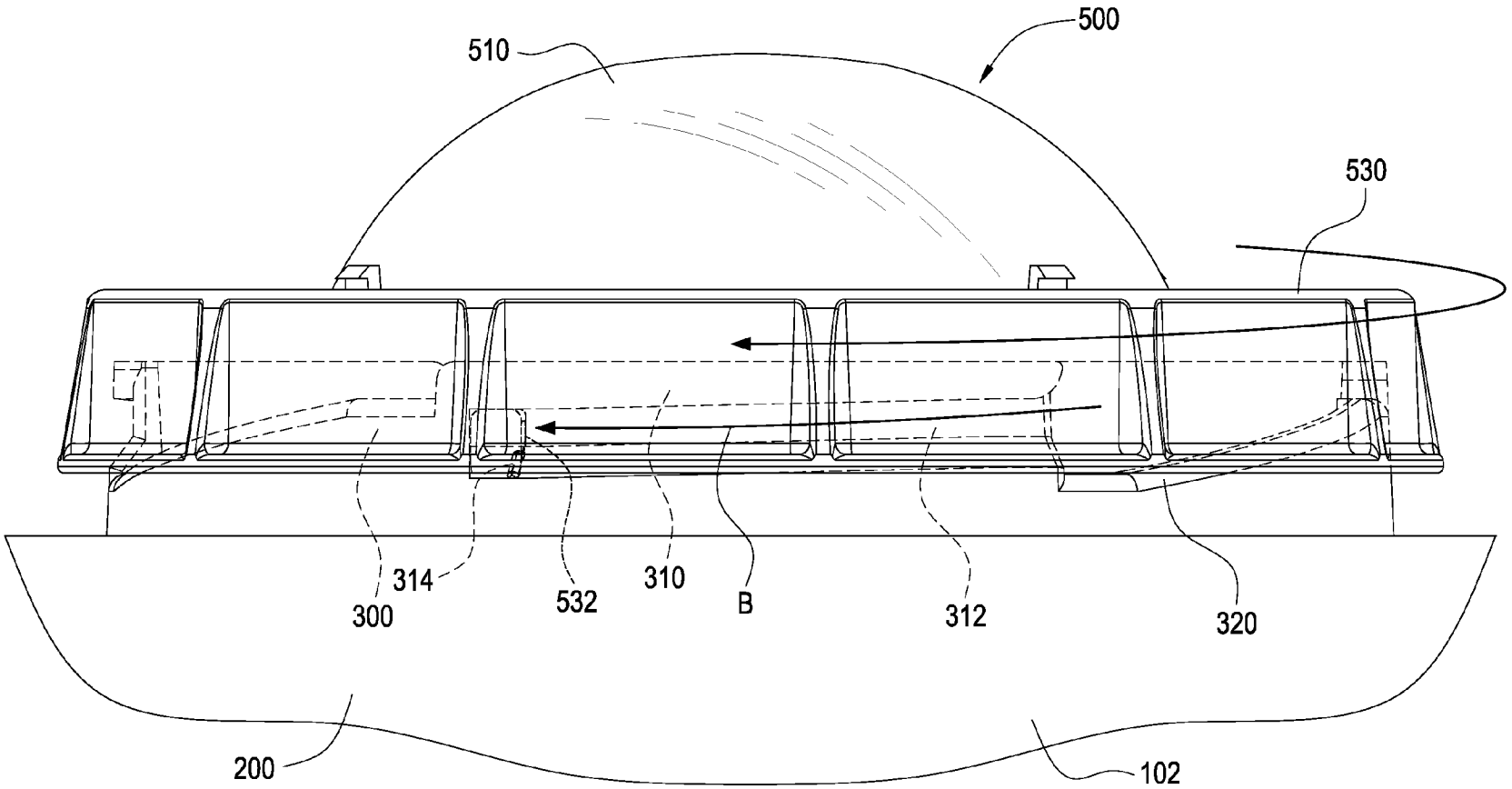
FIG. 8 is a schematic view illustrating the assembled state in which the LED lamp module is assembled to a lamp base according to the present invention.
Figure 9:
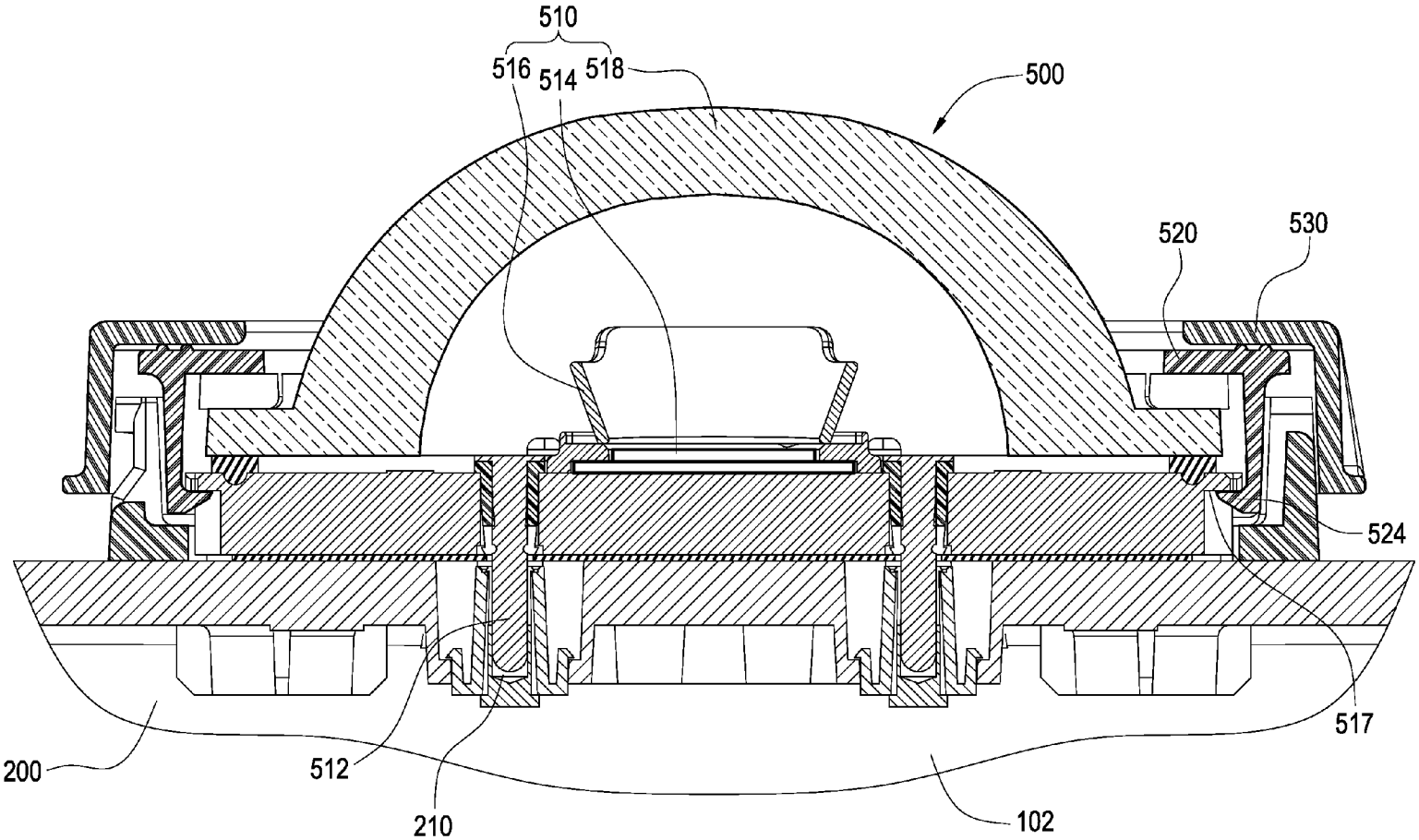
FIG. 9 is a cross-sectional view of FIG. 8.

Referring to FIGS. 6 to 9, detailed descriptions are provided hereinafter to explain how the LED lamp module 500 is assembled to the lamp base 200. To assemble the LED lamp module 500, at first a repairman makes the LED lamp module 500 be in alignment with the lamp base 200. In other words, each conductive terminal 512 of the light source 510 is inserted into a corresponding slot 210 of the lamp base 200 in order to make an electrical connection, as shown in FIG. 9. At this point, the sliding block 532 of the rotatable ring 530 enters into a corresponding one of the notches 320. When the rotatable ring 530 rotates, the sliding block 532 slides along the guiding groove 312 and rotates by an angle B to make the LED lamp module 500 positioned on the lamp base 200 at last.

According to the embodiment shown in FIGS. 7 and 8, an end surface of the guiding groove 312 further has a protruding portion 314 for engagement with the sliding block 532. The angle B hereinbefore is preferably 60 degrees. In other words, a central angle of each press portion 310 (i.e. the guiding groove 312) on the connecting ring 300 is around 60 degrees. However, in different embodiments, the angle B can be around 90 degrees, namely a central angle of each press portion 310 on the connecting ring 300 is around 90 degrees. Since the angle B is very small, even an ordinary user can assemble the LED lamp module 500 to the lamp base 200 fast and efficiently without any tools.

Figure 10:
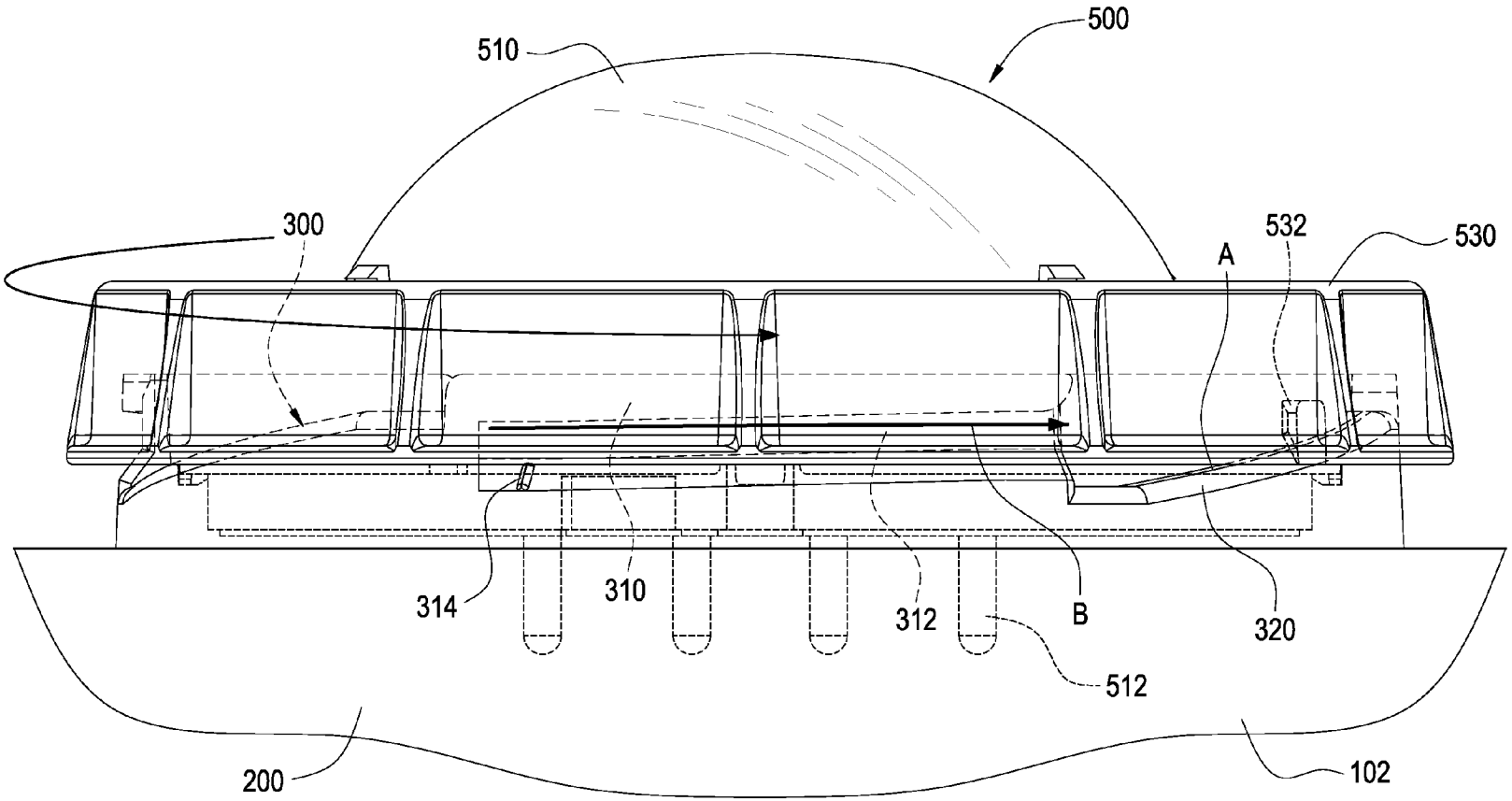
FIG. 10 is a schematic assembly operational view illustrating disassembling the LED lamp module from the lamp base according to the present invention.
Figure 11:
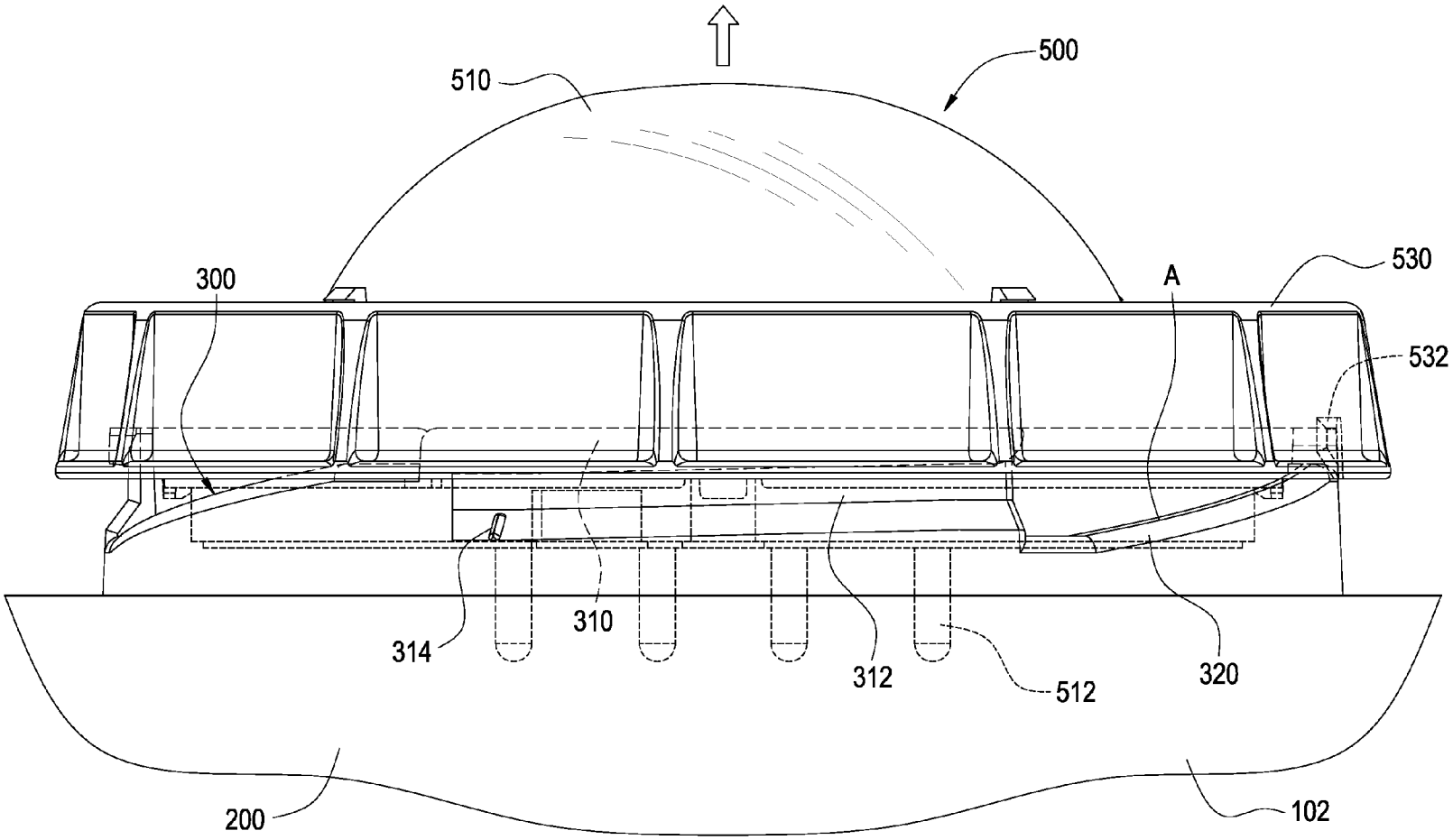
FIG. 11 is another operational view of FIG. 10, which is a schematic view illustrating a state that conductive terminals of the LED lamp module are partially detached from the lamp base.

Referring to FIGS. 10 and 11, to disassemble the LED lamp module 500 from the lamp base 200, the repairman rotates the rotatable ring 530 at first, to make the sliding block 532 of the rotatable ring 530 detached from the protruding portion 314 of the guiding groove 312, until the sliding block 532 slides to the notch 320 of the connecting ring 300 (i.e. rotating by the angle B). When the sliding block 532 of the rotatable ring 530 gradually slides to the highest of the notch 320, owing to the design of the inclined angle A of the notch 320, the LED lamp module 500 is gradually detached from the lamp base 200 in a vertical direction. Referring to FIG. 11, the conductive terminal 512 of the LED lamp module 500 is removed by the connecting ring 300 from the lamp base 200 of the housing body 102 in a vertical direction. Finally, the conductive terminal 512 of the LED lamp module 500 is entirely detached from the slot 210 of the lamp base 200 to complete the disassembly operation.

Therefore, to disassemble the LED lamp module 500, the angle B by which the rotatable ring 530 rotates to disassemble the LED lamp module 500 is very small. Thus, the repairman can disassemble the LED lamp module 500 from the lamp base 200 fast and efficiently without any tools, thereby further preventing damaging the conductive terminals 512 of the LED lamp module 500.

Figure 12:
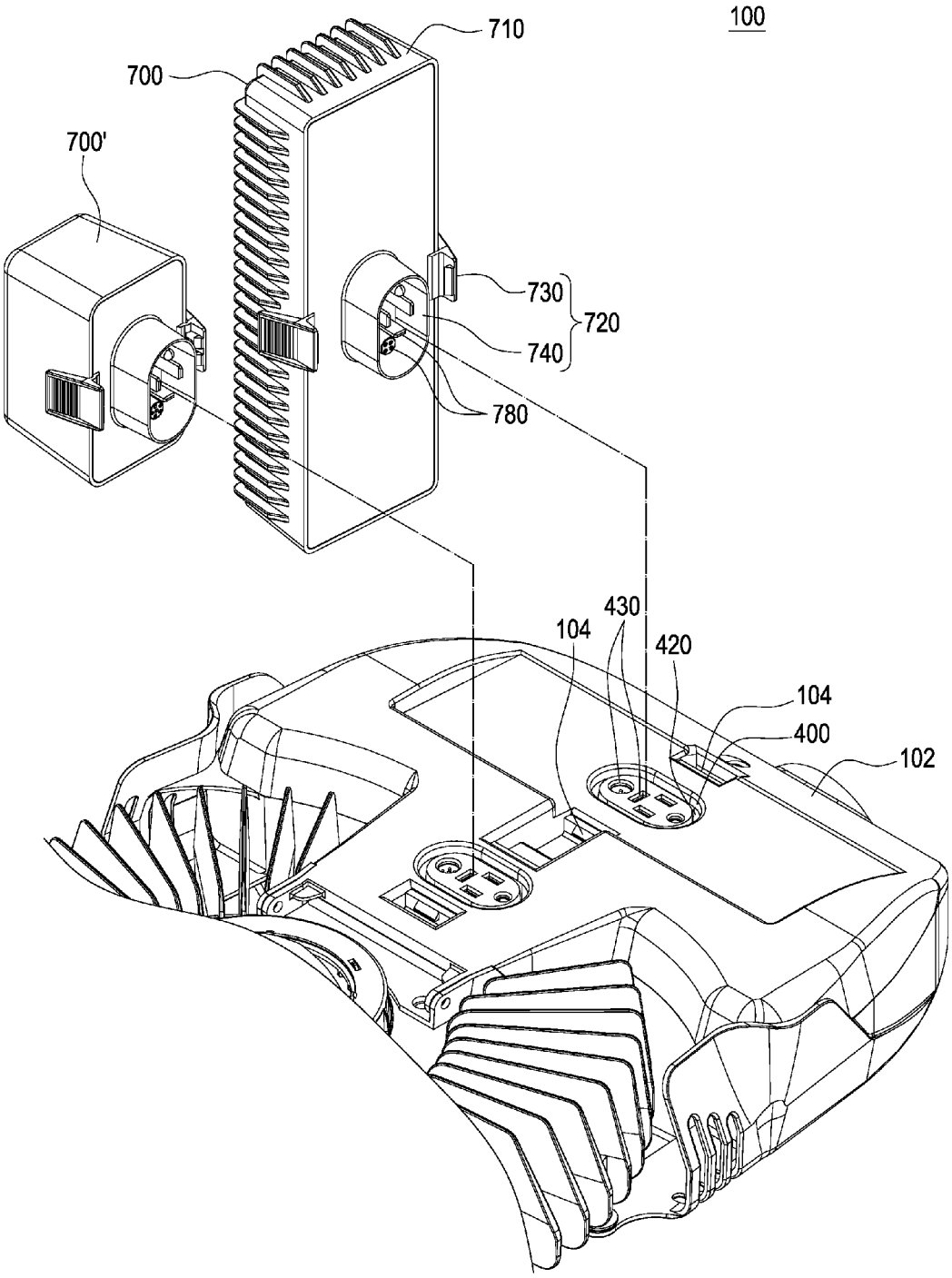
FIG. 12 is a partially enlarged view of the LED lamp structure according to a second embodiment of the present invention.

FIG. 12 is a partially enlarged view of a second embodiment of the present invention, namely a partially enlarged view of between the electronic module 700, 700' and the module base 400. The electronic module 700, 700' includes a casing 710 and a fastening implement 720 connected to the casing 710. The fastening implement 720 has at least one elastic locking element 730, and the elastic locking element 730 is provided for engagement with the clasping member 104. The module base 400 is disposed inside the housing body 102, and a first plate 410 is protrudingly disposed on the module base 400. According to the embodiment shown in FIG. 12, there are preferably two clasping members 104, respectively disposed at two sides of the module base 400 of the housing body 102. Furthermore, the module base 400 further includes at least one power-and-signal socket 430. The aforesaid power-and-signal socket 430 is preferably a three-pin socket, but not limited thereto.

Figure 13:
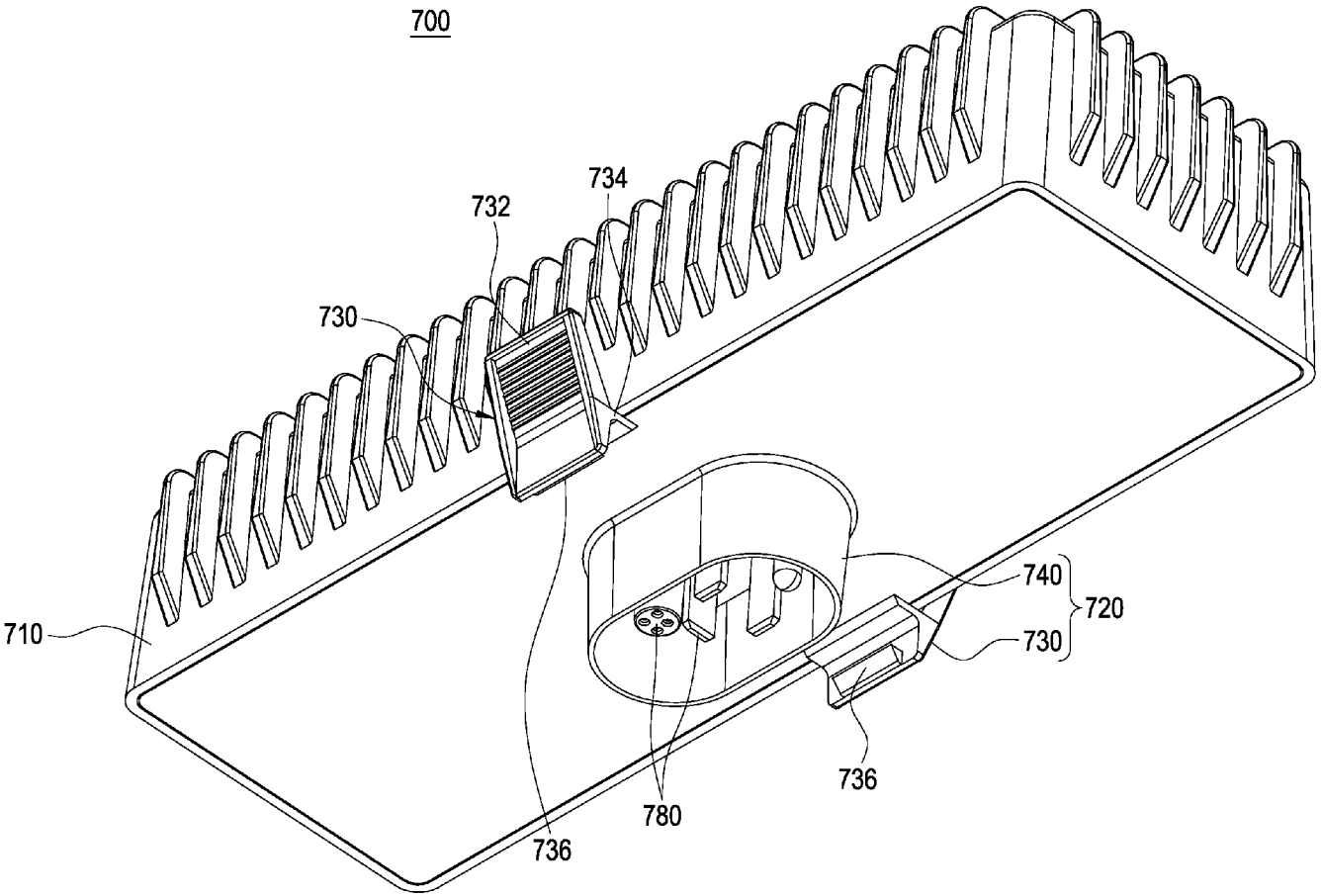
FIG. 13 is a schematic view illustrating an embodiment of one of electronic modules shown in FIG. 12.

Referring to FIGS. 12 and 13, the electronic module 700, 700' comprises at least one casing 710, a fastening implement 720 connected to the casing 710, and a power-and-signal plug 780. The fastening implement 720 includes at least one elastic locking element 730 and a second plate 740. The elastic locking element 730 is provided for engagement with the clasping member 104. According to the present embodiment, the elastic locking element 730 further comprises a press portion 732, a pivoting portion 734, and a hook portion 736. The press portion 732 and the hook portion 736 are disposed on two ends of the pivoting portion 734, respectively. The pivoting portion 734 and the fastening implement 700 can either be integrally formed or be assembled and fixed together by screws (not illustrated) and etc. However, in a different preferable embodiment, the elastic locking element 730 can be integrally formed with or assembled to the casing 710 of the electronic module 700, 700' respectively. An end of the press portion 732 is disposed away from the casing 710. The hook portion 736 is disposed corresponding to the clasping portion 104 and provided for engaging the same.

A length from the press portion 732 to the pivoting portion 734 is greater than a length from the hook portion 736 to the pivoting portion 734. Therefore, when pressing the press portion 732, the press portion 732 rotates around the pivoting portion 734, and thus the hook portion 736 is moved toward a direction away from the second plate 740. Consequently, the hook portion 736 is detached from the clasping member 104, so as to make the electronic module 700, 700' disassembled from the module base 400. Similarly, when assembling the electronic module 700, 700' on the module base 400, the operation is alike.

It should be noted that, the appearances, levels, sizes, and kinds of the power-and-signal socket 430 and the power-and-signal plug 780 vary from country to country, and a repetitive description thereof is omitted herein.

Figure 14:
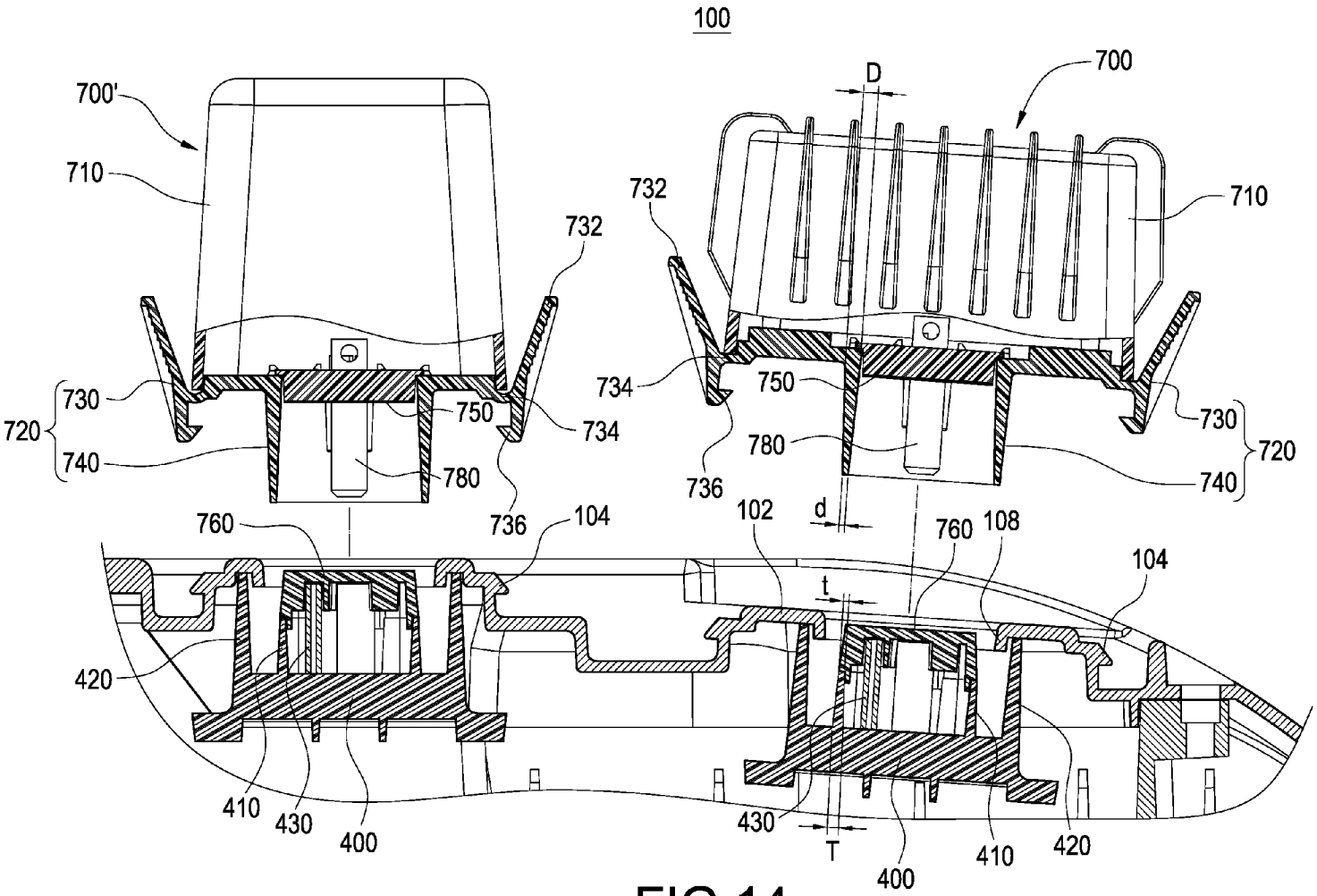
FIG. 14 is a cross-sectional view illustrating a state that the electronic module is not yet assembled to a module base according to the present invention.
Figure 15:
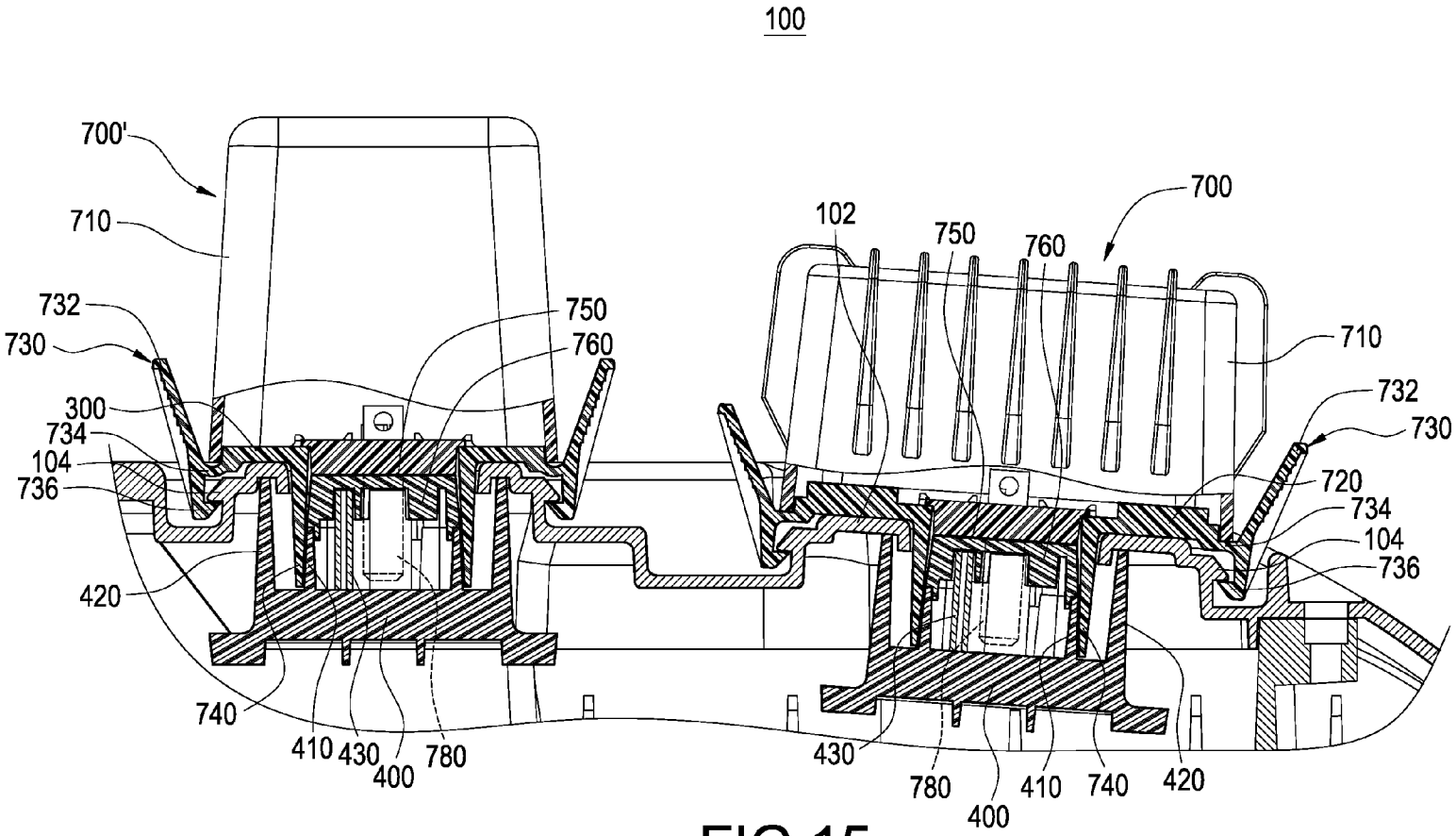
FIG. 15 is a cross-sectional view illustrating a state that the electronic module is assembled to the module base according to the present invention.

Referring to FIGS. 14 and 15, the module base 400 further includes a third plate 420. A top end of the third plate 420 contacts against an inner surface of the housing body 102, and a height of the third plate 420 is preferably greater than a height of the first plate 410. However, in different embodiments, the height of the third plate 420 can be equal to the height of the first plate 410. The housing body 102 further includes an inner recess 108 contacting against the third plate 420 of the module base 400, and thereby moisture is not easy to get into the inside of the housing body 102.

It is preferable that the elastic locking element 730, the second plate 740, and the fastening implement 720 are integrally formed and consist of a material including plastic but not limited thereto. However, in another preferable embodiment, the second plate 740 can be integrally formed with the casing 710 of the electronic module 700, 700'. Furthermore, the fastening implement 720 is preferably fixed to a bottom of the casing 710 of the electronic module 700 by a screw (not illustrated) or other components.

In the embodiment shown in FIG. 14 and FIG. 15, the second plate 740 preferably protrudes toward the first plate 410 and contacts against the first plate 410. In the present embodiment, the first plate 410, the second plate 740, and the third plate 420 are preferably an elliptical ring shape in appearance. However, in different embodiments, the first plate 410, the second plate 740, and the third plate 420 may be in a circular shape, a triangular shape, a trapezoidal shape, a polygonal shape, or any other suitable shape.

It should be noted that, a wall thickness T of the first plate 410 connected to a surface of the module base 400 is thicker than a wall thickness t of the first plate 410 away from the surface of the base 400. A wall thickness D of the second plate 740 connected to a surface of the fastening implement 720 is thicker than a thickness d of the second plate 740 away from the surface of the fastening implement 720. Therefore, when assembling the second plate 740 toward the first plate 410, assembling is easily done for the reason that the thinner wall thicknesses t and d of the first and second plates 410 and 740 produce a guiding effect therebetween. Furthermore, in a assembling process in which the second plate 740 and the first plate 410 are getting closer for assembly, the thicker the wall thicknesses T and D of the first and second plates 410 and 740 are, the more compact the assembly of the first and second plates 410 and 740 is. As shown in FIG. 15, preferably, the first plate 410 is contained within a space confined by the second plate 740 and makes in contact against the same, and thereby moisture is not easy to get into the electronic module 700, 700'.

A lateral side of the hook portion 736 of the elastic locking element 730 has a chamfer angle (not labelled in the drawings), and, a lateral side of the clasping member 104 corresponding to the above-mentioned chamfer angle also has a chamfer angle (not labelled in the drawings). Therefore, it only requires an external force to engage the hook portion 736 with the clasping member 104. More specifically, to assemble the electronic module 700, 700' to the module base 400, a repairman or a user only needs to make the second plate 740 of the fastening implement 720 be in alignment with and then assembled to the first plate 410 of the module base 400, and then the elastic locking element 730 can engage with the clasping member 104. To disassemble/replace the electronic module 700, 700', it only requires pressing the elastic locking element 730 of the fastening implement 720 to detach the hook portion 736 from the clasping member 104, so as to disassemble the electronic module 700, 700' from the module base 400.

Since a structure of the elastic locking element 730 itself has certain elasticity, assembling or replacing can be done without assistance of any other components/tools. Moreover, the simple structure and convenient operation can effectively reduce a repair/maintenance time and a repair/maintenance cost. The standardized fastening implement 720 is suitable for use on any product with the electronic module 700, 700'. Therefore, it is unnecessary to worry about problems such as the products may be pulled off production line, or manufacturing is not easy.

In order to prevent moisture from getting into the structure of the present invention, there are many waterproof designs such as the close contact between the housing body 102 and the third plate 420, the close contact and engagement between the first plate 410 and the second plate 740, and a rubber piece 750 disposed between the power-and-signal plug 780 and the power-and-signal socket 140. As shown in FIGS. 14 and 15, the rubber piece 750 can prevent water from entering into or outside the power-and-signal plug 780 and the power-and-signal socket 430, prevent the moisture from entering into the electronic module 700, 700' along an inner surface of the second plate 740, and protect the power-and-signal plug 430 from deformation or damage by an external force, thereby prolonging life spans of the power-and-signal socket 430, the power-and-signal plug 780, and other electronic components.

In summary, the light emitting diode lamp structure of the present invention certainly can achieve the anticipated objects and improve the defects of conventional techniques, and has novelty and non-obviousness, so the present invention completely meet the requirements of patentability. Therefore, a request to patent the present invention is filed according to patent laws. Examination is kindly requested, and allowance of the present application is solicited to protect the rights of the inventor.

We claimed:

1. A light emitting diode lamp structure, comprising:

a housing body (102), the housing body (102) including a lamp base (200), a module base (400), a connecting ring (300) connecting to the lamp base (200), and at least one clasping member (104) connecting to the module base (400);

a LED lamp module (500), the LED lamp module (500) connecting to the connecting ring (300) and disposed on the lamp base (200); and an electronic module (700, 700'), the electronic module (700, 700') connecting to the clasping member (104) and disposed on the module base (400), wherein the connecting ring (300) further includes a plurality of press portions (310) and a plurality of notches (320) spaced apart from one another and respectively disposed between each two adjacent press portions (310), and a guiding groove (312) is formed on an outer surface of each of the press portions (310).

2. The LED lamp structure of claim 1, wherein each of the notches (320) and the press portions (310) is equidistant from one another on the connecting ring (300), and the guiding groove (312) is adjacent to each of the notches (320), the guiding groove (312) and a surface of the housing body (102) together include an inclined angle (A).

3. The LED lamp structure of claim 2, wherein an inclination direction of the inclined angle (A) is from away from a surface of the housing body (102) gradually toward the surface of the housing body (102).

4. The LED lamp structure of claim 1, wherein the LED lamp module (500) further comprises a light source (510) and a rotatable ring (530) enclosing the light source (510), and an inner wall of the rotatable ring (530) has a sliding block (532) correspondingly and rotatably engaged with the guiding groove (312), wherein an end surface of the guiding groove (312) further includes a protruding portion (314) for engagement with the sliding block (532).

5. The LED lamp structure of claim 4, wherein the LED lamp module (500) further includes a joining ring (520) and an elastic positioning portion (522), the joining ring (520) is provided for positioning the light source (510), the elastic positioning portion (522) is disposed on an end surface of the joining ring (520), a plurality of openings (534) are further formed on an outer surface of the rotatable ring (530), and the elastic positioning portion (522) is rotatably engagable with the openings (534).

6. The LED lamp structure of claim 5, wherein the sliding block (532) of the rotatable ring (530) is further correspondingly and rotatably engaged with the guiding groove (312) by an angle (B), and the elastic positioning portion (522) is movable from one of the openings (534) to engage an adjacent or corresponding another one of the openings (534).

7. The LED lamp structure of claim 4, wherein the lamp base (200) further includes a plurality of slots (210) therein, the light source (510) further comprises a plurality of conductive terminals (512) for insertion into the slots (210).

8. The LED lamp structure of claim 1, wherein the electronic module (700) further comprises a casing (710) and a fastening implement (720) connected to the casing (710), the fastening implement (720) has at least one elastic locking element (730), and the elastic locking element (730) is provided for engaging the clasping member (104).

9. The LED lamp structure of claim 8, wherein at least one elastic locking element (730) further comprises a press portion (312), a pivoting portion (734), and a hook portion (736); the press portion (732) and the hook portion (736) are disposed on two ends of the pivoting portion (734) respectively; an end of the press portion (732) is disposed away from the casing (710); and the hook portion (736) is provided for engagement with the clasping member (104).

10. The LED lamp structure of claim 9, wherein a length from the press portion (732) to the pivoting portion (734) is greater than a length from the hook portion (736) to the pivoting portion (734).

11. The LED lamp structure of claim 9, wherein the module base (400) is disposed inside the housing body (102), a first plate (410) is protrudingly disposed on the module base (400), the fastening implement (720) includes a second plate (740), and the second plate (740) protrudes toward the first plate (410) and contacts against the first plate (410).

12. The LED lamp structure of claim 11, wherein the first plate (410) is further contained inside a space confined by the second plate (740) and contacts against the same.

13. The LED lamp structure of claim 11, wherein the appearance of the first plate (410) and the second plate (740) includes a circular shape, a triangular shape, a trapezoidal shape, or a polygonal shape.

14. The LED lamp structure of claim 11, wherein a wall thickness (D) of the second plate (740) connected to a surface of the fastening implement (720) is thicker than a wall thickness (d) of the second plate (740) away from the surface of the fastening implement (720).

15. The LED lamp structure of claim 11, wherein the module base (400) further includes a third plate (420), a top end of the third plate (420) contacts against an inner surface of the housing body (102), and a height of the third plate (420) is greater or equal to a height of the first plate (410).

16. The LED lamp structure of claim 15, wherein the housing body (102) further includes an inner recess (108) contacting against the third plate (420) of the module base (400).

17. The LED lamp structure of claim 11, wherein a wall thickness (T) of the first plate (410) connected to a surface of the module base (400) is thicker than a wall thickness (t) of the first plate (410) away from the surface of the module base (400).

18. The LED lamp structure of claim 1, wherein the electronic module (700, 700') further comprises a power-and-signal supply device or a wireless inductive device including at least one power-and-signal plug (780), and the module base (400) comprises at least one power-and-signal socket (430) for insertion thereinto of the at least one power-and-signal plug (780) in order to make an electrical connection.

19. The LED lamp structure of claim 18, wherein a rubber piece (750, 760) is disposed between the power-and-signal plug (780) and the power-and-signal socket (430).

* * * * *